US006131240A

United States Patent [19]

Shark et al.

[11] Patent Number: 6,131,240

[45] Date of Patent: Oct. 17, 2000

[54] CARPET CLEANER

[75] Inventors: Eric Shark, Lakewood; Gene Bothun, Loveland; Clay Costanzo, Lakewood, all of Colo.

[73] Assignee: Windsor Industries, Inc., Englewood, Colo.

[21] Appl. No.: 09/250,778

[22] Filed: Feb. 12, 1999

[51] Int. Cl.[7] ..... A47L 5/34

[52] U.S. Cl. ..... 15/355; 15/320

[58] Field of Search ..... 15/354, 355, 321, 15/322

[56] References Cited

U.S. PATENT DOCUMENTS

| | | | |
|---|---|---|---|
| 1,081,340 | 12/1913 | Spangler | 15/355 |
| 1,104,613 | 7/1914 | Bodey . | |
| 1,119,393 | 12/1914 | Binkley . | |
| 1,180,679 | 4/1916 | Thompson . | |
| 1,237,793 | 8/1917 | Krantz . | |
| 1,348,585 | 8/1920 | Rosenfield | 15/355 |
| 1,440,759 | 1/1923 | Wright . | |
| 1,543,972 | 6/1925 | Adams . | |
| 1,764,666 | 6/1930 | White . | |
| 1,976,998 | 10/1934 | Kirby | 15/8 |
| 2,184,401 | 12/1939 | Sellers | 15/6 |
| 3,747,155 | 7/1973 | Koellisch | 15/321 X |
| 4,075,733 | 2/1978 | Parise et al. | 15/322 |
| 4,139,922 | 2/1979 | Fitch | 15/321 |
| 5,623,743 | 4/1997 | Burgoon et al. | 15/320 |

FOREIGN PATENT DOCUMENTS

| | | | |
|---|---|---|---|
| 927750 | 6/1963 | United Kingdom | 15/355 |

*Primary Examiner*—Chris K. Moore
*Attorney, Agent, or Firm*—Sheridan Ross P.C.

[57] ABSTRACT

A cleaning machine is disclosed having an adjustment apparatus that allows a selected cleaning depth to be maintained, even where the cleaning apparatus has been raised to facilitate transport of the cleaning machine from one area to be cleaned to another. The adjustment apparatus therefore eliminates the need to reset the cleaning depth where the carpet being cleaned is of the same depth as the last area that was cleaned. The disclosed cleaning machine also features a vacuum housing having an integral seal, which provides for a more reliable seal, and simplifies assembly of the housing.

20 Claims, 8 Drawing Sheets

CARPET CLEANER

FIELD OF THE INVENTION

The present invention relates to cleaning machines, and in particular, to carpet cleaning machines that allow the cleaning apparatus to be raised and lowered relative to other parts of the cleaning machine while maintaining a selected cleaning position.

BACKGROUND OF THE INVENTION

Carpet cleaning machines have been devised for accomplishing a number of cleaning objectives. A feature that has been incorporated into such machines relates to properly positioning the cleaning assembly or debris pick-up assembly, such as a brush or other agitator, relative to the carpet being cleaned.

In one prior art implementation of a machine for cleaning carpets and available from the assignee of the present application, a movable cleaning assembly is included. The cleaning assembly can be raised and lowered relative to other parts of the cleaning machine using a lifting mechanism. The cleaning assembly has a raised position when it is desired to transport the cleaning machine from one area that has been cleaned to another area that needs to be cleaned. This prior art cleaning assembly can be lowered to a selected one of a 1 number of cleaning positions or settings. Depending upon the physical makeup of the carpet, such as the lengths of the carpet strands or piles, the operator of the cleaning machine can choose one of the selectable cleaning assembly positions. With such selectable cleaning assembly positions being available, the operator determines the cleaning assembly position to be selected and, after doing so, keeps the cleaning assembly at this selected position. The operator may decide to move the cleaning system to its raised or stored position during the cleaning of a particular carpet. When moved to this stored position, the cleaning assembly no longer is in the selected position for cleaning this particular carpet. Consequently, if the operator wishes to continue cleaning this carpet after moving the cleaning assembly to its stored position, the operator is required to remember this previously selected floor (leaning position. If the operator does not remember this previously selected position, further efforts must be taken to arrive at the desired selected cleaning assembly position and a mistake may occur in which the operator does not return the cleaning assembly to an optimum cleaning position.

With respect to assisting the operator in maintaining a selected cleaning assembly position for a particular carpet being cleaned, it would be worthwhile to provide a mechanism that does not require the operator to remember the selected cleaning assembly position, particularly where the cleaning assembly is raised to its stored or non-cleaning position before cleaning of the particular carpet is finished.

SUMMARY OF THE INVENTION

In accordance with the present invention, a carpet cleaning machine is disclosed in which the cleaning apparatus may be adjusted to suit different thicknesses of carpet and in which a selected position may be maintained even after the cleaning apparatus has been raised to facilitate transport of the carpet cleaning machine from one area to be cleaned to another. The carpet cleaning machine includes a cleaning assembly having a cleaning member for loosening dirt and debris from the surface to be cleaned, and a vacuum assembly for removing debris and moisture from the surface being cleaned. Disposed between and connected to each of the cleaning assembly and the vacuum assembly is an adjustment assembly. The adjustment assembly allows the height of the cleaning assembly to be set at any one of a number of selectable positions relative to the vacuum assembly. Thus, the height of the cleaning assembly can be properly positioned relative to the carpet being cleaned. Together, the cleaning assembly, vacuum assembly, and adjustment assembly generally comprise the cleaning apparatus. Because the adjustment assembly operates separately from the provided mechanism for lifting the entire cleaning apparatus from the floor surface, the cleaning apparatus may be raised or lowered without changing the selected adjustment assembly position.

The adjustment assembly includes a loop-shaped adjustment rod rotatably attached to a bushing on the cleaning assembly link member. Fixedly attached to the upper portion of the adjustment rod is an adjustment member, which may be selectively positioned within any one of a plurality of slots in a notched element, which is itself fixedly attached to the upper portion of a flange connected to the vacuum assembly. The slots in the notched element each have a unique depth, allowing the selection of any one of a number of cleaning assembly heights relative to the vacuum assembly. The position of the adjustment member within a slot is maintained by a compression spring disposed about a portion of the adjustment rod.

The height of the cleaning assembly relative to the vacuum assembly is adjusted by raising the cleaning apparatus to the first, or storage position, introducing a downward force to the vacuum housing to move the vacuum housing down in relation to the cleaning assembly, thereby compressing the spring around the adjustment rod and moving the notched element down away from the adjustment member. Once the adjustment member has cleared the slots in the notched element, it may be rotated to a position above a different slot. The force on the vacuum housing may then be removed, allowing the adjustment member to engage the newly selected slot. The cleaning apparatus lift lever may then be returned to a second, or cleaning position, and cleaning recommenced.

The flange on the vacuum assembly may be attached to the vacuum assembly in such a way that the angle of the vacuum assembly relative to the surface to be cleaned can be varied. It is desirable to orient the vacuum housing such that it is substantially perpendicular to the surface being cleaned. Therefore, it is advantageous to provide for such an adjustment.

The vacuum assembly may feature a vacuum housing with flow control elements to define section pathways that maintain a vacuum along the lower opening of the vacuum assembly. The vacuum housing is formed such that it has seals that are integral with the vacuum housing. Front and/or back plates may then be attached directly to the vacuum housing without requiring the inclusion of separate seals or gaskets.

The present invention allows the operator of the carpet cleaning machine to lift the cleaning apparatus to facilitate transport of the carpet cleaning machine between areas of carpet to be cleaned without requiring that the height adjustment of the cleaning assembly be reset. Therefore, the present invention eliminates the possibility that an inattentive operator will inadvertently select the wrong cleaning depth or forget what the correct cleaning depth is. The present invention also allows cleaning to recommence quickly after traveling to a new area to be cleaned, as the correct cleaning depth will have already been selected, provided that the carpet in the new area is of the same depth as the carpet in the area previously cleaned. Thus, the present invention increases efficiency by helping to ensure that the correct cleaning depth is selected, and by decreasing the time required to recommence cleaning after transporting the machine from one area to be cleaned to the next.

The present invention is further advantageous in that it provides for a method of sealing flow channels provided in the vacuum housing wherein the seals are integral to the vacuum housing itself. This eliminates the need for separate gaskets or seals, decreases assembly time, and reduces the possibility that the housing will be incorrectly assembled. Furthermore, the present invention provides means for ensuring that the most advantageous angle between the vacuum housing and the surface to be cleaned is maintained by providing for adjustment means on the vacuum assembly.

Additional advantages of the present invention will become readily apparent from the following discussion, particularly when taken together with the accompanying drawings.

DETAILED DESCRIPTION

In accordance with the present invention an apparatus is provided to permit the cleaning apparatus of a carpet cleaning machine to be raised or lowered relative to the rest of the apparatus while maintaining a selected cleaning position.

Figure 1:
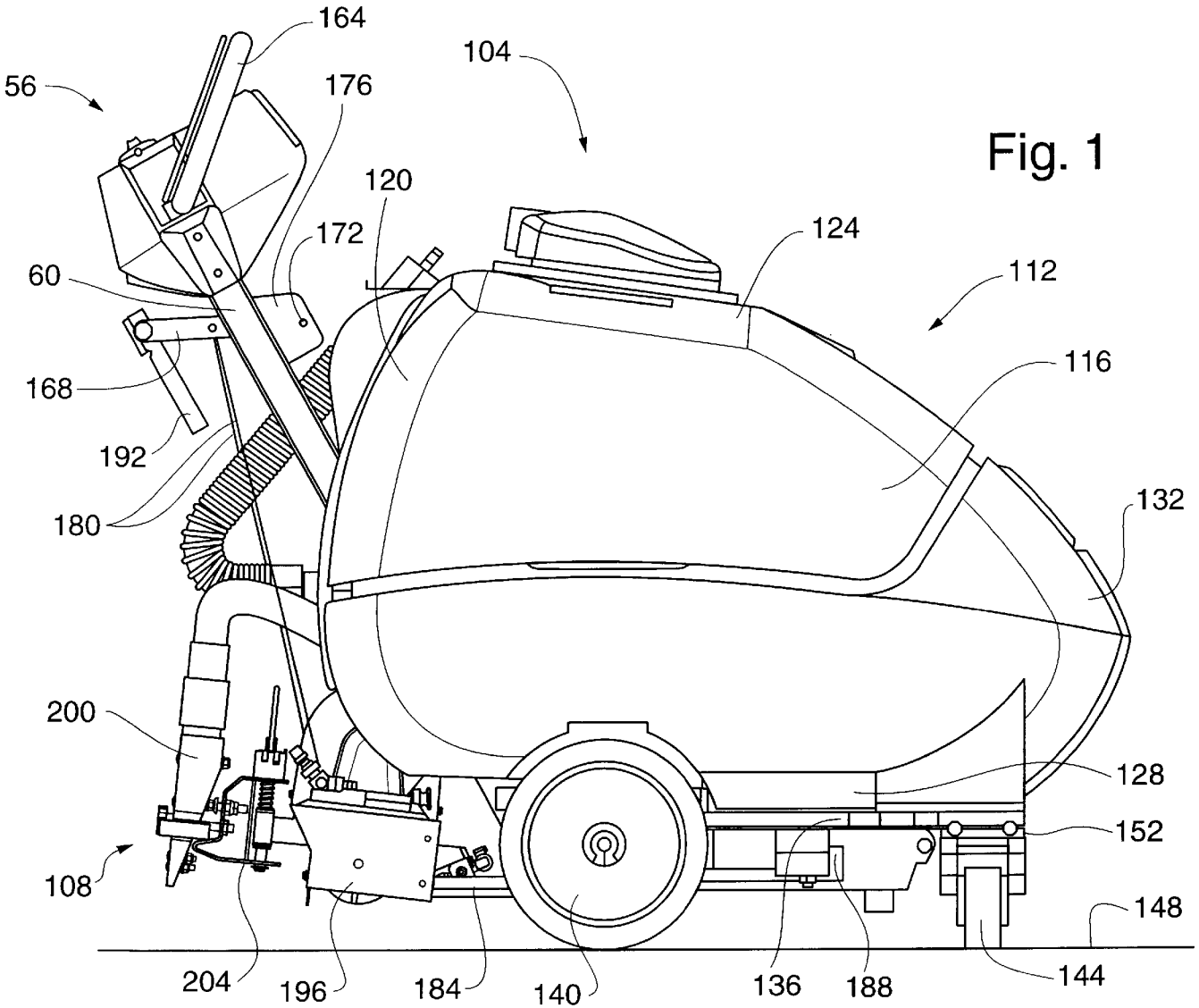
FIG. 1 is a side elevational view of the carpet cleaning machine with the cleaning apparatus in the raised position.

With reference to FIG. 1, the apparatus, identified generally as the cleaning machine 104, is shown in profile, with the cleaning apparatus 108 in a raised position. The cleaning machine 104 is preferably a carpet cleaner that includes a housing 112 generally having sidewalls 116, a back wall 120, a top 124, a bottom 128, and a front wall 132. The housing 112 is supported by a frame 136 having rear wheels 140 and front wheels 144. The rear wheels 140 and the front wheels 144 are in contact with the floor surface 148. In the illustrated embodiment, the front wheels 144 are mounted on swivels 152 to allow the cleaning machine 104 to be easily turned.

Figure 2:
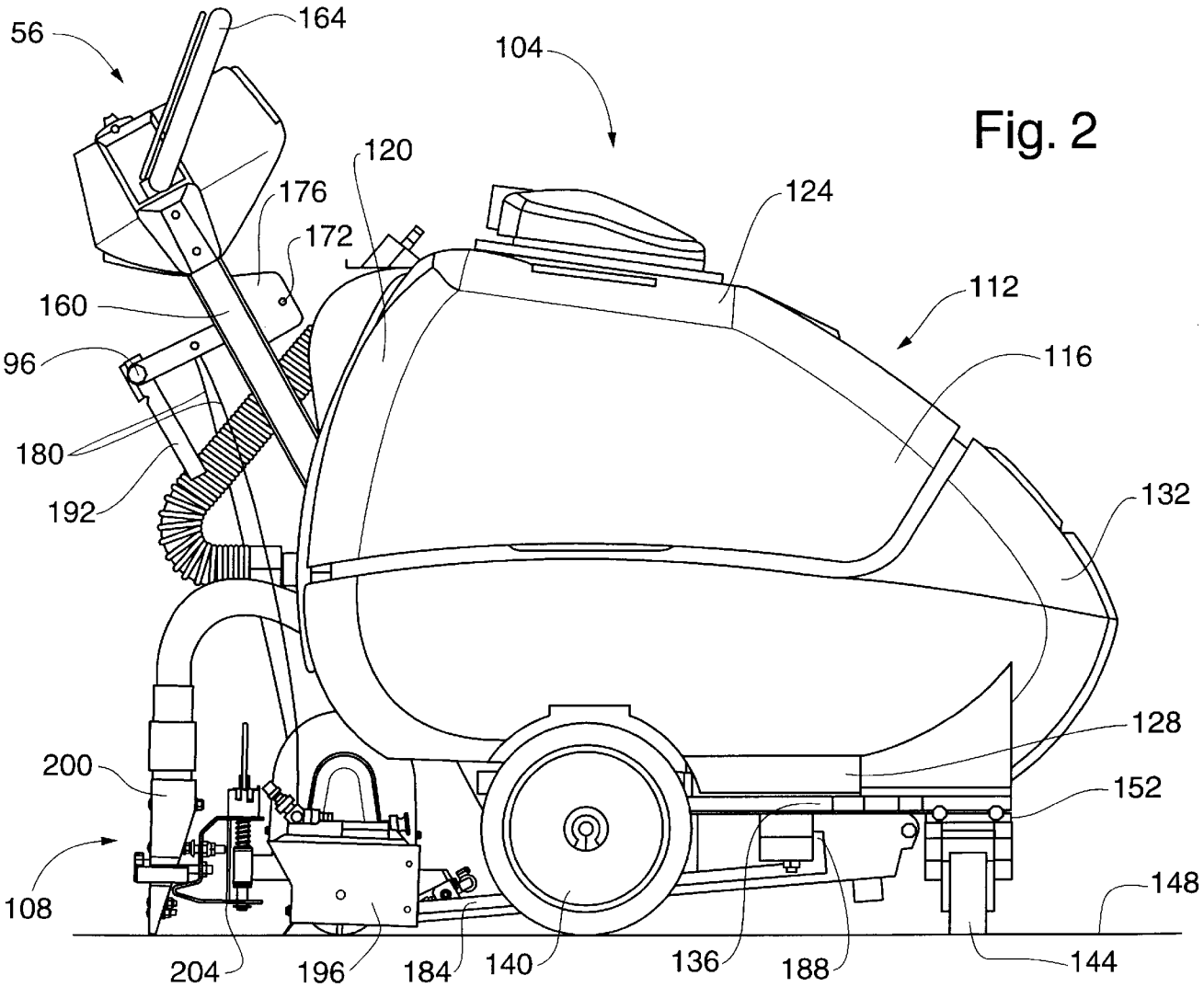
FIG. 2 is a side elevational view of the carpet cleaning machine with the cleaning apparatus in the lowered position.

A tower assembly 156 is attached at one end to the frame 136 via a support member 160. The tower assembly 156 rises in a substantially vertical direction adjacent to the back wall 120 of the cleaning machine 104. At the end of the support member 160 opposite the frame 136 is a handle 164. Below the handle 164 is a cleaning apparatus lift lever 168. The lift lever 168 is connected to the support member 160 at pivot 172 through the lift lever support plate 176, and is movable between a first selected position (illustrated in FIG. 1) and a second selected position (illustrated in FIG. 2). Cables 180 are fixed at a first end to the lift lever 168, and at a second end to the cleaning apparatus 108.

The cleaning apparatus 108 is mounted at a forward edge to cleaning apparatus pivot arms 184, which are in turn pivotally mounted to the frame 136 at cleaning apparatus pivots 188. When the lift lever 168 is moved from a second selected position to a first selected position, the cables 180 are drawn upwardly, the cleaning apparatus 108 and pivot arms 184 rotate about the cleaning apparatus pivots 188. The result of this rotation is that the cleaning apparatus 108 is raised from a second, or cleaning position (illustrated in FIG. 2), to a first, or raised position (illustrated in FIG. 1). To facilitate bringing the cleaning apparatus 108 to the raised position, the lift lever 168 may be provided with a lift lever handle 192. The cleaning apparatus is generally comprised of the cleaning assembly 196, the vacuum assembly 200, and the adjustment assembly 204.

Figure 3:
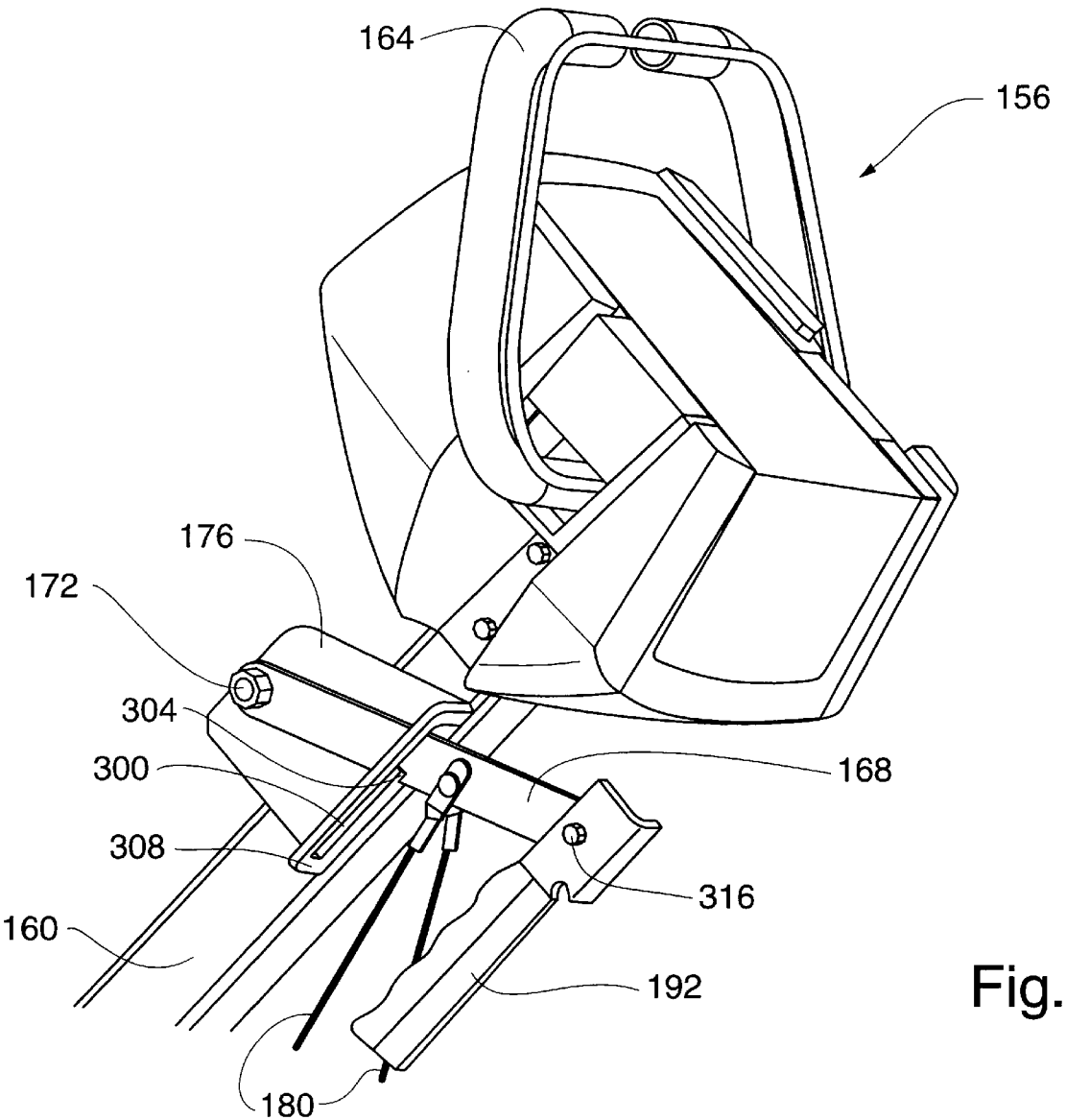
FIG. 3 is rear perspective view illustrating the lifting lever in the raised position.

Referring now to FIG. 3, the details of the lift lever 168 can more easily be seen. The lift lever 168 may be moved within the lift lever slot 300, which is formed in the lift lever support plate 176, by pivoting the lift lever 168 about the lift lever pivot 172. The lift lever slot 300 is shaped like an inverted J, having a first stop 304 and a second stop 308. Lateral play in the lift lever pivot 172 may be provided to allow the lift lever 168 to be moved from a first position, resting against the first stop 304, to a second position, resting against the second stop 308. A lift lever handle 192, which rotates about a pivot 316 to a folded position when not in use, may also be provided.

When the lift lever 168 is moved from the second position to the first position, tension is introduced to the cables 180. This tension pivots the cleaning assembly 108 about the cleaning apparatus pivots 188, raising it relative to the floor surface 148. This raised, or storage position is useful when moving the cleaning machine 104 from one area to be cleaned to another. When the next area to be cleaned has been reached, the lift lever 168 may be moved in the lift lever slot 300 from the first position to the second position, which lowers the cleaning apparatus, and places it in a position to clean the floor surface 148.

Figure 4:
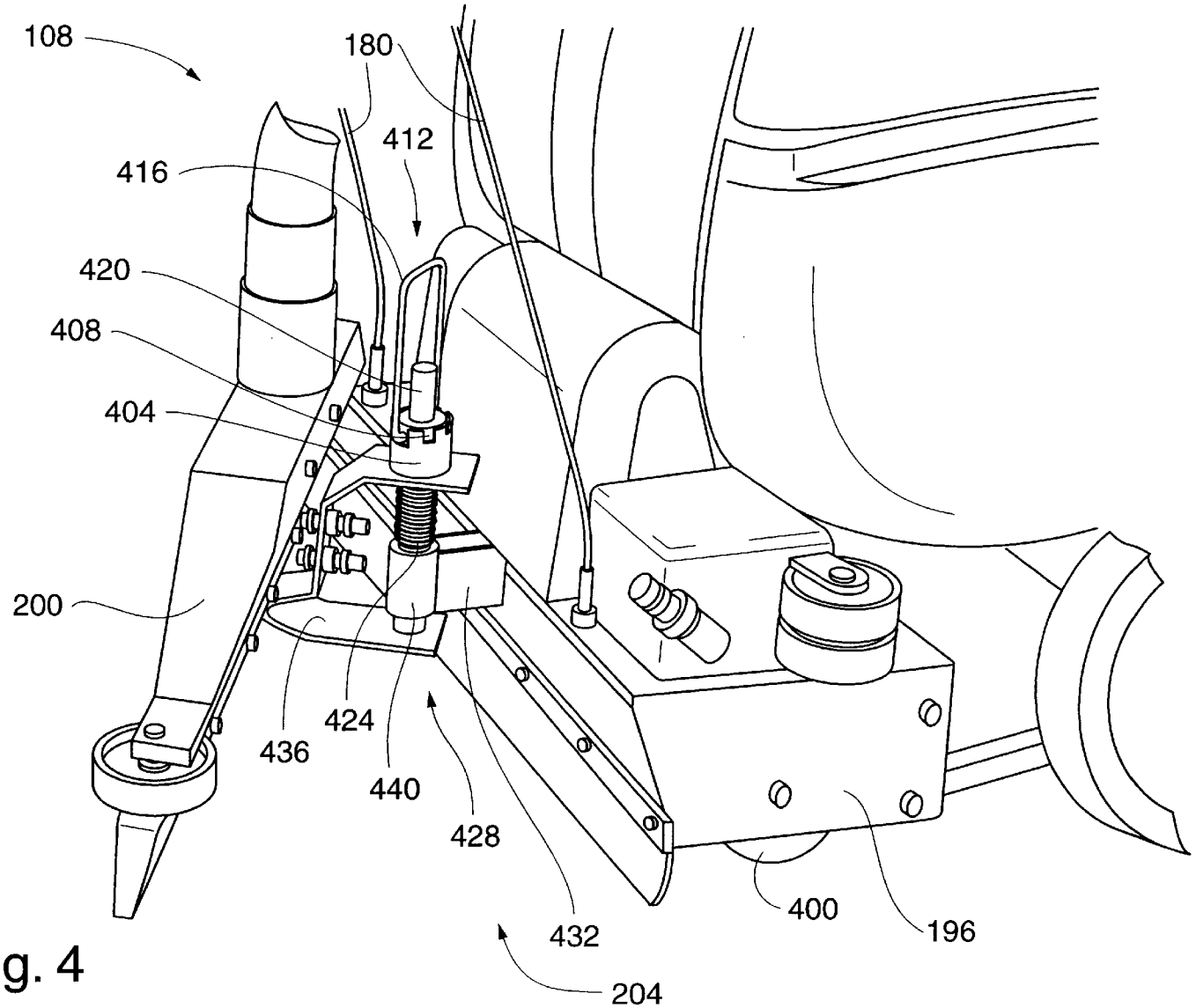
FIG. 4 is a perspective view of the cleaning apparatus, with the adjustment member of the adjustment assembly engaged in a notch.

Referring to FIG. 4, the cleaning apparatus 108 is illustrated in greater detail. The cleaning apparatus 108 is comprised generally of the cleaning assembly 196 and the vacuum assembly 200. The cleaning assembly 196 includes a cleaning member 400, which may comprise a brush, beater bar, agitator, or other means for loosening dirt and debris from the floor surface 148 to be cleaned. Disposed between the cleaning assembly 196 and the vacuum assembly 200 is the adjustment assembly 204. The adjustment assembly 204 provides means for adjusting the height of the cleaning assembly 196 relative to the height of the vacuum assembly 200. The provision of such a height adjustment is useful for accommodating, for example, different thicknesses of carpet.

The adjustment assembly 204 includes a notched element 404. The notched element 404 is generally in the shape of a hollow cylinder, with a plurality of slots 408 of varying depths disposed about one end of the cylinder. The adjustment assembly 204 also includes an adjustment rod sub-assembly 412 having a loop-shaped adjustment member 416 fixedly attached to an adjustment rod 420. The adjustment assembly 204 further includes a compression spring 424 disposed about portions of the adjustment rod 420, and a connection sub-assembly 428 comprising a link member 432 connected to the cleaning assembly 196, and a flange 436 connected to the vacuum assembly 200.

The adjustment rod 420 of the adjustment rod sub-assembly 412 is free to rotate about its longitudinal axis within a bushing 440 formed within the link member 432. However, vertical movement of the adjustment rod 420 is prevented by snap rings (not shown) positioned on the adjustment rod 420 on either side of the bushing 440. The flange 436 is fixedly connected to the notched element 404, and is carried by the adjustment rod 420. Upward movement of the flange is constrained by the adjustment member 416, which in normal operation rests in one of the plurality of slots 408 formed in the notched element 404.

Figure 5:
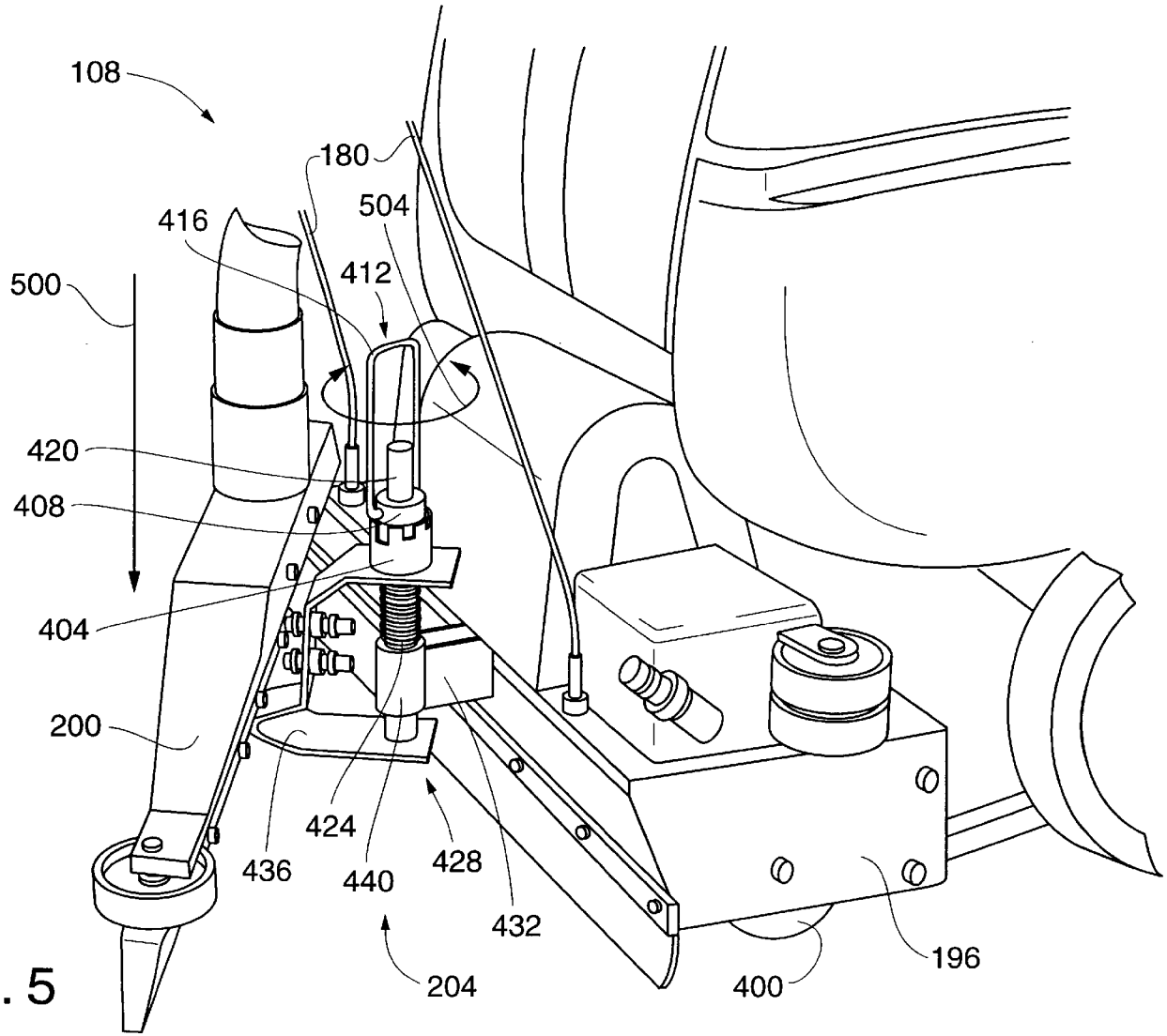
FIG. 5 is a perspective view of the cleaning apparatus, with the vacuum assembly depressed with respect to the cleaning assembly, and the adjustment member apart from the notches.
Figure 7:
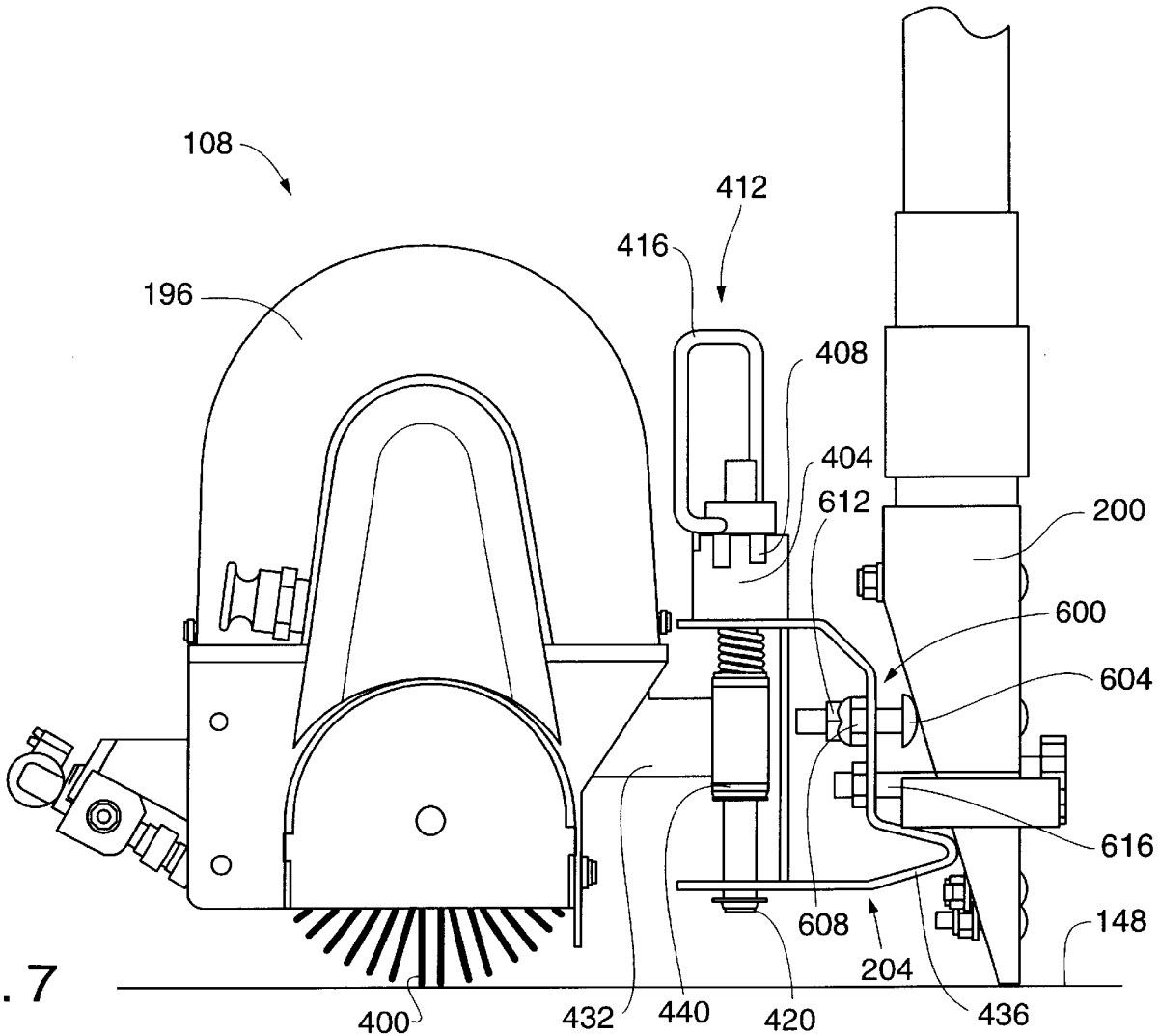
FIG. 7 is a side view of the cleaning and vacuum assemblies, showing the cleaning assembly raised with respect to the vacuum assembly.

Referring now to FIGS. 5 and 7, to adjust the height of the cleaning assembly 196 relative to that of the vacuum assembly, the cleaning apparatus 108 is placed in the raised position by moving the cleaning apparatus lift lever from the second position against the second stop 308, to the first position resting against the first stop 304. The operator then places a downward force 500 on the vacuum assembly 200, compressing the spring 424, and moving the notched element 408 down in relation to the adjustment member 416. When the vacuum assembly 200 has been moved a sufficient distance, the adjustment member 416 can disengage from the slots provided in the notched element 408. Once the adjustment member 416 is free from the last selected slot of the notched element 408, the adjustment member 416 may be rotated 504 to a position over a new selected slot. The force on the vacuum assembly can then be released, allowing the notched element to rise about the adjustment member 416, and allowing the adjustment member 416 to engage the newly selected slot. The compression spring 424 maintains the adjustment member 416 in position in the selected slot. Because the depth of each slot is unique, changing the slot that the adjustment member 416 is engaged with changes the height of the cleaning assembly 196 relative to the vacuum assembly 200. After the desired slot has been selected, the lift lever 168 may be returned to the second stop 308, lowering the cleaning apparatus 108 into contact with the floor surface 148 to be cleaned, whereupon cleaning may recommence.

Figure 6:
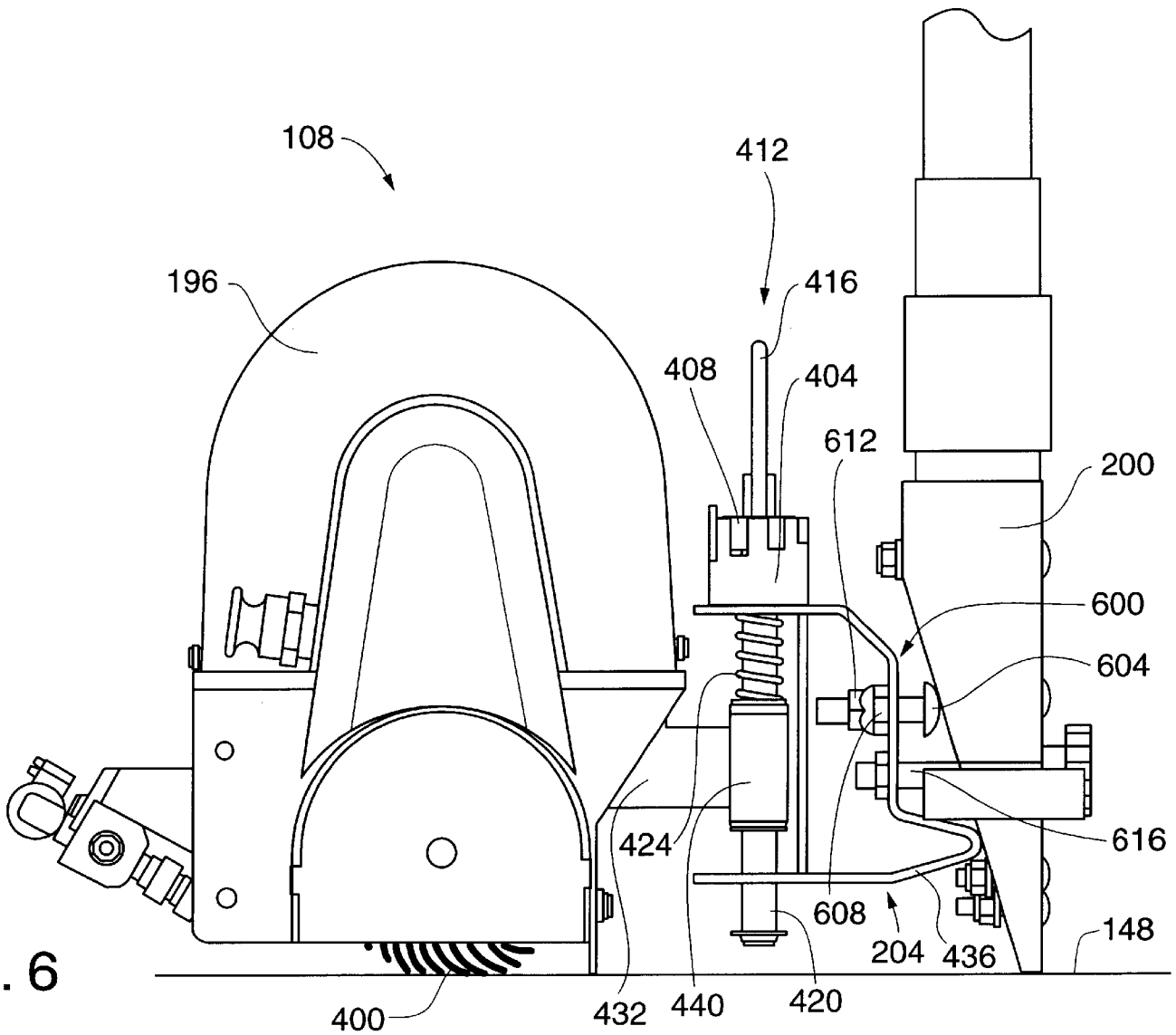
FIG. 6 is a side view of the cleaning and vacuum assemblies, showing the cleaning assembly lowered with respect to the vacuum assembly.

Referring now to FIG. 6, the adjustment assembly 204 also includes a vertical alignment sub-assembly 600, which is generally comprised of a bolt 604 threadibly engaged with a nut 608 fixedly attached to the flange 436. A lock-nut 612 may be included to ensure that a selected position is maintained. The vertical alignment sub-assembly 600 allows the vacuum assembly 200 to be adjusted so that it is perpendicular to the floor surface 148 to be cleaned by changing the position of the bolt 604 within the flange 436. If the bolt 604 is screwed in or out with respect to the flange 436, the vacuum assembly 200 will be caused to pivot about the extended part of the flange 436.

Figure 8:
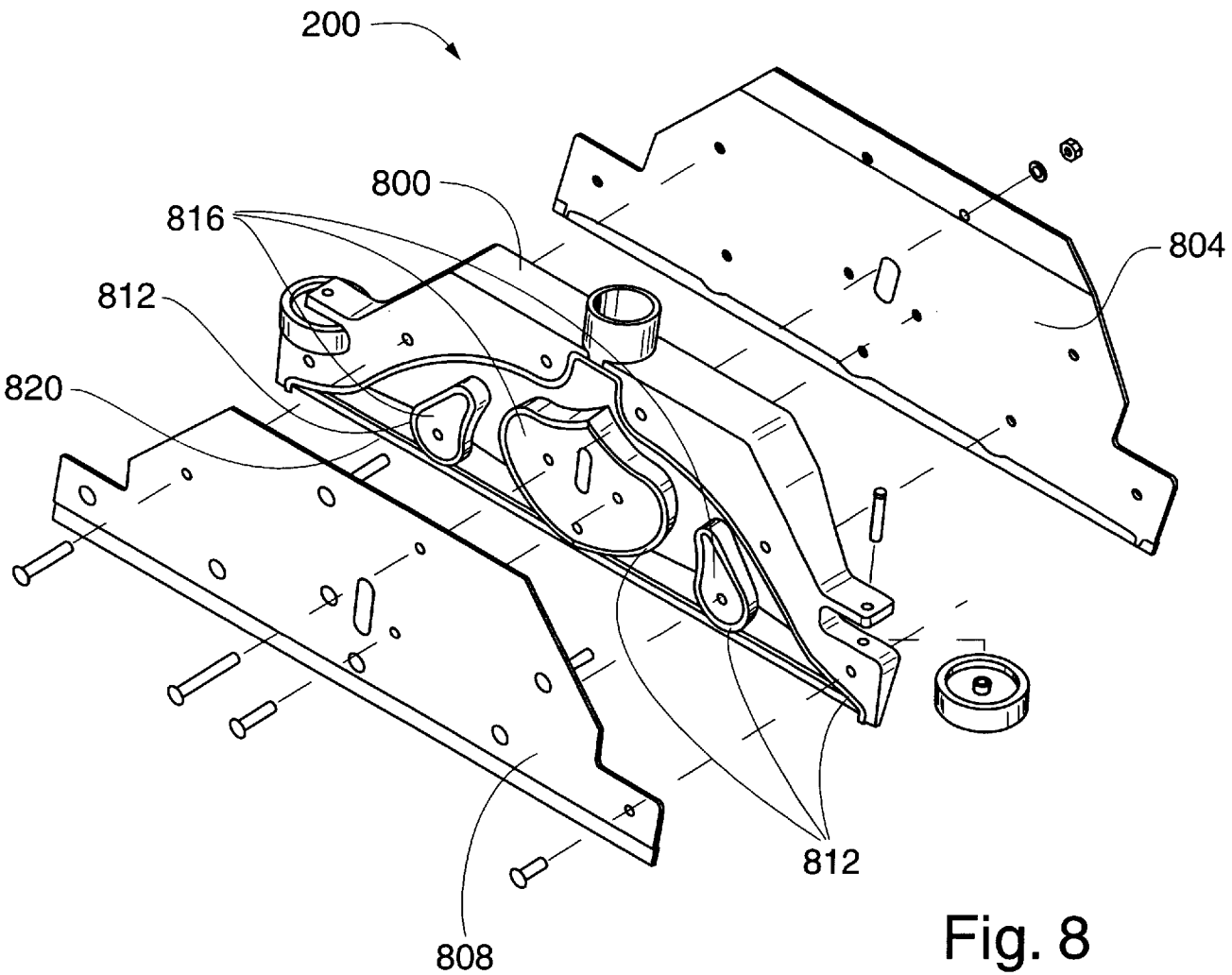
FIG. 8 is an exploded view of the vacuum assembly.

Referring now to FIG. 8, the vacuum assembly 200 is comprised of a vacuum housing 800, a front plate 804, and a rear plate 808. An air-tight seal between the vacuum housing 800 and the front 804 and rear 808 plates is maintained by seal strips 812 that are formed as an integral part of the vacuum housing 800. These seal strips 812 prevent the possibility of improperly assembling the vacuum assembly 200 and inviting leaks which reduce the amount of vacuum available at the surface to be cleaned. Such improper assembly is common when conventional gaskets or separate seal strips are used, as such systems require that the gasket or seal be precisely positioned on the vacuum housing 800 before final assembly. Flow control elements 816 may be provided, also with integral seal strips 812, to maintain a vacuum along the mouth of the vacuum housing 820.

The invention in its broader aspects relates to an apparatus for cleaning floor surfaces that maintains a preselected cleaning depth even after the cleaning apparatus has been raised for transport from one area to be cleaned to another. Thus, the apparatus allows the operator to determine and set the correct height of the cleaning apparatus once for a given type of surface to be cleaned, reducing the amount of time required before cleaning can recommence after traveling to a new area to be cleaned, and increasing the efficacy of such cleaning by helping to ensure that the correct cleaning depth is maintained. The apparatus may be used on a wide variety of cleaning machines, and may be constructed using a minimal number of component parts.

For purposes of clarity, the following is a list of components shown in the drawings and the numbering associated therewith:

| Component Number | Component |
|---|---|
| 104 | Cleaning Machine |
| 108 | Cleaning Apparatus |
| 112 | Housing |
| 116 | Housing Sidewalls |
| 120 | Housing Back Wall |
| 124 | Housing Top |
| 128 | Housing Bottom |
| 132 | Housing Front Wall |
| 136 | Frame |
| 140 | Rear Wheels |
| 144 | Front Wheels |
| 148 | Floor Surface |
| 152 | Front Wheel Swivels |
| 156 | Tower Assembly |
| 160 | Support Member |
| 164 | Handle |
| 168 | Cleaning Apparatus Lift Lever |
| 172 | Lift Lever Pivot |
| 176 | Lift Lever Support Plate |
| 180 | Cables |
| 184 | Lift Lever Pivot Arms |
| 188 | Cleaning Apparatus Pivots |
| 192 | Lift Lever Handle |
| 196 | Cleaning Assembly |
| 200 | Vacuum Assembly |
| 204 | Adjustment Assembly |
| 300 | Lift Lever Slot |
| 304 | First Stop, Storage Position |
| 308 | Second Stop, Cleaning Position |
| 316 | Lift Lever Handle Pivot |
| 400 | Cleaning Member |
| 404 | Notched Element |
| 408 | Notched Element Slots |
| 412 | Adjustment Rod Sub-Assembly |
| 416 | Adjustment Member |
| 420 | Adjustment Rod |
| 424 | Compression Spring |
| 428 | Connection Sub-Assembly |
| 432 | Link Member |
| 436 | Flange |
| 440 | Bushing |
| 500 | Downward Force on Vacuum Assembly |
| 504 | Rotational Force on Adjustment Member |
| 600 | Vertical Alignment Sub-Assembly |
| 604 | Vertical Alignment Bolt, Upper |
| 608 | Vertical Alignment Nut |
| 612 | Vertical Alignment Lock-Nut |

-continued

| Component Number | Component |
|---|---|
| 616 | Vertical Alignment Bolt, Lower |
| 800 | Vacuum Housing |
| 804 | Vacuum Housing, Front Plate |
| 808 | Vacuum Housing, Rear Plate |
| 812 | Seal Strips |
| 816 | Flow Control Elements |
| 820 | Mouth of Vacuum Housing |

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include alternative embodiments to the extent permitted by the prior art.

What is claimed is:

1. A floor cleaning machine, comprising:

a cleaning assembly that includes a brush for cleaning a surface;

a housing assembly having a height;

a lifting assembly operably connected to said cleaning assembly, said lifting assembly also being operably connected to said housing assembly and said lifting assembly having a storage position for said brush and a cleaning position for said brush, said brush being in said storage position when transporting the floor cleaning machine and said brush being in said cleaning position when said brush is cleaning the surface, wherein said cleaning position is a single position and is the only position selected using said lifting assembly when said brush is used to clean the surface;

a vacuum assembly operably connected to said cleaning assembly for suctioning materials from the surface; and an adjustment assembly operably connected to each of said cleaning assembly and said vacuum assembly for positioning said brush at a first selected position of a number of selectable positions relative to the surface.

2. A floor cleaning machine, comprising:

a cleaning assembly for cleaning a surface and including a cleaning member and a lifting assembly to which said cleaning assembly is operably connected that controls movement of said cleaning assembly between a cleaning position and a storage position relative to the surface;

a housing assembly to which said cleaning assembly is operably connected;

a vacuum assembly operably connected to said cleaning assembly for suctioning materials from the surface, said vacuum assembly including a vacuum housing and a seal strip formed integrally with a section of said vacuum housing; and an adjustment assembly operably connected to each of said cleaning assembly and said vacuum assembly for positioning said cleaning member at a first selected position of a number of selectable positions relative to the surface.

3. A cleaning machine, as claimed in claim 1, wherein:

said vacuum assembly includes a housing having a front plate, a back plate and a vacuum body disposed therebetween and with said vacuum body including a seal strip.

4. A cleaning machine, as claimed in claim 1, wherein:

said vacuum assembly includes a vacuum body having a suction pathway defined by a number of flow control elements.

5. A cleaning machine, as claimed in claim 1, wherein:

said adjustment assembly includes a notched element having a number of slots, with each of said slots associated with one of said selectable positions including said first selected position.

6. A cleaning machine, as claimed in claim 5, wherein:

said adjustment assembly includes an adjustment rod sub-assembly having an adjustment member, wherein said adjustment member can be positioned in a first slot associated with said first selected position.

7. A floor cleaning machine, comprising:

a cleaning assembly for cleaning a surface and including a cleaning member and a lifting assembly operably connected to said cleaning assembly that controls movement of said cleaning member between a cleaning position and a storage position relative to the surface;

a housing assembly to which said cleaning assembly is operably connected;

a vacuum assembly operably connected to said cleaning assembly for suctioning materials from the surface; and an adjustment assembly operably connected to each of said cleaning assembly and said vacuum assembly for positioning said cleaning member at a first selected position of a number of selectable positions relative to the surface, said adjustment assembly including a notched element having a number of slots including a first slot, with each of said slots associated with one of said selectable positions, said adjustment assembly further including an adjustment rod sub-assembly having an adjustment member, wherein said adjustment member can be positioned in said first slot associated with said first selected position, said adjustment assembly including a compression spring disposed about portions of a rod and in which said compression spring is compressed when positioning said cleaning assembly in said first slot corresponding to said first selected position.

8. A floor cleaning machine, comprising:

a cleaning assembly for cleaning a surface and including a cleaning member and a lifting assembly operably connected to said cleaning assembly that controls movement of said cleaning assembly between a cleaning position and a storage position relative to the surface;

a housing assembly operably connected to said cleaning assembly;

a vacuum assembly operably connected to said cleaning assembly for suctioning materials from the surface; and an adjustment assembly operably connected to each of said cleaning assembly and said vacuum assembly for positioning said cleaning member at a first selected position of a number of selectable positions relative to the surface, said adjustment assembly including a connection sub-assembly that includes a link member connected to said cleaning assembly and a flange connected to said vacuum assembly and with each of said link member and said flange being movable for positioning said cleaning assembly relative to the surface.

9. A cleaning machine, as claimed in claim 8, wherein:

said connection sub-assembly includes a bushing connected to said link member and being spaced from said flange.

10. A cleaning machine, as claimed in claim 8, wherein:

said adjustment assembly includes a notched element having a number of slots and said flange includes an upper leg and in which said upper leg is connected to said notched element.

11. A floor cleaning assembly, comprising:

a cleaning assembly for cleaning a surface and including a cleaning member and a lifting assembly operably connected to said cleaning assembly that controls movement of said cleaning assembly between a cleaning position and a storage position relative to the surface;

a housing assemble operably connected to said cleaning assembly;

a vacuum assembly operably connected to said cleaning assembly for suctioning the materials from the surface; and an adjustment assembly operably connected to each of said cleaning assembly and said vacuum assembly for positioning said cleaning assembly at a first selected position of a number of selectable positions relative to the surface, said adjustment assembly including an alignment sub-assembly that angularly adjusts said vacuum assembly with respect to a vertical plane.

12. A cleaning machine, as claimed in claim 1, wherein:

said adjustment assembly includes a notched element having a number of slots with different longitudinal heights that extend in a substantially vertical direction relative to said height of said housing assembly and in which said different longitudinal heights are related to positioning said brush relative to the surface.

13. A floor cleaning machine, comprising:

a cleaning assembly for cleaning a surface and including a cleaning member and a lifting assembly operably connected to said cleaning assembly that controls movement of said cleaning assembly between a cleaning position and a storage position relative to the surface;

a housing assembly to which said cleaning assembly is operably connected;

a vacuum assembly operably connected to said cleaning assembly for suctioning materials from the surface; and an adjustment assembly disposed between and connected to each of said cleaning assembly and said vacuum assembly for positioning said cleaning assembly at a first selected position of a number of selectable positions relative to the surface, said adjustment assembly including a notched element having a number of different slots with different longitudinal heights that extend in substantially vertical direction relative to a height of the floor cleaning machine, said notched element being movable to change positions of said cleaning assembly relative to the surface.

14. A cleaning machine, as claimed in claim 13, wherein:

said adjustment assembly includes a rod sub-assembly that is stationary relative to the surface when adjustment of said notched element is being made.

15. A cleaning machine, as claimed in claim 1, wherein:

said brush can be changed from said first selected position to a second selected position and when said brush is changed to said second selected position said vacuum assembly is moved in a direction substantially towards the surface.

16. A method for adjusting a cleaning assembly of a cleaning machine, comprising:

providing a cleaning assembly including a cleaning member and a vacuum assembly operably connected to said cleaning assembly;

cleaning a surface using said cleaning assembly while in a cleaning position and in which said cleaning member has a first selected position;

changing said cleaning assembly to a storage position from said cleaning position while maintaining said cleaning member at said first selected position, wherein said vacuum assembly is located above and free of contact with the surface when said cleaning assembly is in said storage position; and adjusting said cleaning member to a second selected position while said cleaning assembly is in said storage position using an adjustment assembly, said adjusting step includes pushing on said vacuum assembly by an operator to cause said vacuum assembly to move in a downward direction.

17. A method, as claimed in claim 16, wherein:

said providing step includes interconnecting said cleaning assembly and said vacuuming assembly using said adjustment assembly disposed therebetween.

18. A method, as claimed in claim 16, wherein:

said adjustment assembly includes a rod sub-assembly and a notched element having slots including a first slot related to said first selected position and said adjusting step further includes moving said notched element relative to said rod sub-assembly.

19. A method, as claimed in claim 18, wherein:

said moving step includes moving said notched element against a force provided by a compression spring.

20. A method, as claimed in claim 16, farther including:

aligning said vacuum assembly with respect to a vertical plane using a vertical alignment member connected to said adjustment assembly.

* * * * *